US005807813A

United States Patent [19]

Yamada

[11] Patent Number: 5,807,813

[45] Date of Patent: Sep. 15, 1998

[54] LUBRICATING OIL COMPOSITION

[75] Inventor: Ryou Yamada, Ichihara, Japan

[73] Assignee: Idemitsu Kosan Co., Ltd., Tokyo, Japan

[21] Appl. No.: 793,752

[22] PCT Filed: Jul. 17, 1996

[86] PCT No.: PCT/JP96/01988

§ 371 Date: Mar. 14, 1997

§ 102(e) Date: Mar. 14, 1997

[87] PCT Pub. No.: WO97/04048

PCT Pub. Date: Feb. 6, 1997

[30] Foreign Application Priority Data

Jul. 20, 1995 [JP] Japan ..... 7-183886

[51] Int. Cl.[6] ..... C10M 135/18; C10M 137/10; C10M 145/00

[52] U.S. Cl. ..... 508/363; 508/364; 508/379; 508/444; 508/438

[58] Field of Search ..... 508/363, 364, 508/379, 380, 525, 438, 444

[56] References Cited

U.S. PATENT DOCUMENTS

| | | | |
|---|---|---|---|
| 4,812,246 | 3/1989 | Yabe | 508/364 |
| 4,832,867 | 5/1989 | Seiki et al. | 508/364 |
| 4,877,541 | 10/1989 | Wisotsky et al. | 508/444 |
| 5,076,945 | 12/1991 | Habeeb | 508/525 |

*Primary Examiner*—Sharon Gibson
*Assistant Examiner*—Cephia D. Toomer
*Attorney, Agent, or Firm*—Oblon, Spivak, McClelland, Maier & Neustadt, P.C.

[57] ABSTRACT

A lubricating oil composition comprising a base oil, (A) at least one compound selected from the group consisting of molybdenum dithiocarbamate and molybdenum dithiophosphate, and (B) an aromatic compound having at least one functional group selected from the group consisting of hydroxyl group, carboxyl group, mercapto group, and thiocarboxyl group on the aromatic ring. The lubricating oil composition maintains the low friction property to achieve sustained low fuel consumption during the use and also enables using the organic molybdenum compound added as the friction modifier in a smaller amount than the amount required in conventional lubricating oil compositions.

3 Claims, No Drawings

LUBRICATING OIL COMPOSITION

This application is a 371 of PCT/JP96/019881,filed Jul. 17, 1996.

TECHNICAL FIELD

The present invention relates to a lubricating oil composition. Particularly, the present invention relates to a lubricating oil composition which enables exhibiting the low friction effect of organic molybdenum compounds for a longer time. More particularly, the present invention relates to a lubricating oil composition which maintains the low friction property to achieve sustained low fuel consumption during the use, enables using the organic molybdenum compound added as the friction modifier in a smaller amount than the amount required in conventional lubricating oil compositions, and can particularly advantageously be used as a lubricating oil for internal combustion engines.

BACKGROUND ART

Heretofore, lubricating oils are used in internal combustion engines, driving apparatus, such as automatic transmissions, shock absorbers, power steering, and the like, and gears in order to achieve smooth movements of these apparatus. Particularly, lubricating oils for internal combustion engines (generally called engine oils) play the roll of lubricating various types of sliding part, such as combinations of piston rings and cylinder liners, combinations of crank shafts and bearings of connecting rods, and moving valve mechanisms including cams and valve lifters, and also play the roll of cooling the inside of engines, cleaning and dispersing combustion products, and preventing rust and corrosion.

As described above, various properties are required for a lubricating oil. Particularly in recent years, decrease in the friction coefficient of engine oil is required for the purpose of improving fuel economy. Heretofore in internal combustion engines, because friction parts to which lubricating oils are related cause a large energy loss, friction modifiers, such as molybdenum dithiophosphate (MoDTP) and molybdenum dithiocarbamate (MoDTC), are frequently used in order to decrease the friction loss and the fuel consumption. However, it has been pointed out that oils containing MoDTP or MoDTC lose the expected effect significantly at an early time of use.

The decrease in the expected effect of the organic molybdenum compound at an early time of use has heretofore been considered to be caused by consumption of the molybdenum compound. Therefore, the added amount of the molybdenum compound is generally increased to compensate the amount lost by the decomposition. However, it has been found in recent years that the decrease in the effect is caused by the formation of degradation products of fuels (degradation acids) although the consumption of the organomolybdenum compound is small.

On the other hand, many studies have been conducted on the mechanism of the function of the molybdenum compound. For example, studies have been conducted on the effect of the type of the compound, the effect of the atmosphere, and the interaction of the compound with zinc dithiophosphate (ZnDTP) which is one of additives to engine oils. However, one study alone can be found in relation to the sustenance of the effect, i.e., it was reported in "Preprints for Scientific Meeting of Automotive Engineers, Japan", Volume 952, Page 207 that the effect of MoDTP to improve fuel consumption could be maintained by increasing the used amount of MoDTP and by simultaneously using an additive containing sulfur.

Under the above circumstance, the present invention has the object of providing a lubricating oil composition which maintains the low friction property to achieve sustained low fuel consumption during the use, enables using the organic molybdenum compound added as the friction modifier in a smaller amount than the amount required in conventional lubricating oil compositions, and can particularly advantageously be used as a lubricating oil for internal combustion engines.

DISCLOSURE OF THE INVENTION

As the result of extensive studies conducted by the present inventors to develop the lubricating oil composition having the above advantageous properties, it was discovered that the object can be achieved by the combined use of MoDTP or MoDTC and an aromatic compound having a specific group on the aromatic ring. The present invention has been completed on the basis of the discovery.

Accordingly, the present invention provides a lubricating oil composition comprising a base oil, (A) at least one compound selected from the group consisting of molybdenum dithiocarbamate and molybdenum dithiophosphate, and (B) an aromatic compound having at least one functional group selected from the group consisting of hydroxyl group, carboxyl group, mercapto group, and thiocarboxyl group.

THE MOST PREFERRED EMBODIMENT TO CARRY OUT THE INVENTION

As the base oil in the lubricating oil composition of the present invention, a mineral oil or a synthetic oil is generally used. The type and other properties of the mineral oil or the synthetic oil are not particularly limited. A mineral oil or a synthetic oil having a kinematic viscosity in the range of 0.5 to 50 $mm^2$/sec, preferably in the range of 1 to 30 $mm^2$/sec, at 100° C. is generally used. Examples of the mineral oil include paraffinic mineral oils, intermediate mineral oils, and naphthenic mineral oils which are obtained by a conventional refining process, such as the solvent refining and the hydro-refining.

Examples of the synthetic oil include polybutene, polyolefins (polymers and copolymers of a-olefins), various types of esters (such as polyolesters, esters of dibasic acids, and esters of phosphoric acid), various types of ethers (such as polyphenyl ethers), alkylbenzenes, and alkylnaphthalenes.

In the present invention, a single type or a combination of two or more types of the above mineral oil can be used as the base oil. A single type or a combination of two or more types of the above synthetic oil can also be used as the base oil. A combination of one or more types of the mineral oil and one or more types of the synthetic oil can be used as the base oil as well.

In the lubricating composition of the present invention, at least one compound selected from the group consisting of molybdenum dithiocarbamate (MoDTC) and molybdenum dithiophosphate (MoDTP) both having the function of the friction modifier are used as component (A).

The chemical structure of MoDTC is not fully elucidated. Examples of MoDTC include compounds represented by the following general formula (I):

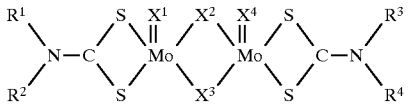

(I)

The chemical structure of MoDTP is not fully elucidated either. Examples of MoDTP include compounds represented by the following general formula (II):

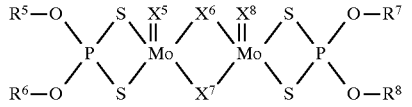

(II)

In above general formula (I) and (II), $R^1$ to $R^8$ represent each a hydrocarbon group having 4 to 24 carbon atoms. Examples of the hydrocarbon group having 4 to 24 include alkyl groups having 4 to 24 carbon atoms, alkenyl groups having 4 to 24 carbon atoms, aryl groups having 6 to 24 carbon atoms, and arylalkyl groups having 7 to 24 carbon atoms. Hydrocarbon groups having 3 or less carbon atoms cause inferior solubility of the molybdenum compound into the base oil. When the number of carbon atom in a hydrocarbon group is 25 or more, the effect is saturated, and moreover the organic molybdenum compound having such a hydrocarbon group is difficult to obtain. $R^1$ to $R^4$ may be the same with each other or different from each other. $R^5$ to $R^8$ may be the same with each other or different from each other.

The above alkyl group having 4 to 24 carbon atoms and the above alkenyl group having 4 to 24 carbon atoms may have a linear chain structure, a branched chain structure, or a ring structure. Examples of the alkyl group having 4 to 24 carbon atoms and the alkenyl group having 4 to 24 carbon atoms include n-butyl group, isobutyl group, sec-butyl group, tert-butyl group, n-hexyl group, isohexyl group, n-octyl group, 2-ethylhexyl group, n-nonyl group, isononyl group, n-decyl group, isodecyl group, n-dodecyl group, isododecyl group, n-tridecyl group, isotridecyl group, n-pentadecyl group, isopentadecyl group, n-hexadecyl group, isohexadecyl group, n-octadecyl group, isooctadecyl group, n-eicosyl group, isoeicosyl group, cyclopentyl group, cyclohexyl group, oleyl group, and linoleyl group. The above aryl group having 6 to 24 carbon atoms and the above arylalkyl group having 7 to 24 carbon atoms may have one or more substituents, such as alkyl groups, on the aromatic ring. Examples of the aryl group having 6 to 24 carbon atoms and the arylalkyl group having 7 to 24 carbon atoms include phenyl group, tolyl group, xylyl group, naphthyl group, butylphenyl group, octylphenyl group, nonylphenyl group, benzyl group, methylbenzyl group, butylbenzyl group, phenetyl group, methylphenetyl group, and butylphenetyl group.

In view of the solubility into the base oil, the effect, and the availability of the organic molybdenum compound, hydrocarbon groups having 4 to 13 carbon atoms are preferable, and alkyl groups having 4 to 13 carbon atoms are more preferable among these hydrocarbon groups.

In above general formulae (I) and (II), $X^1$ to $X^8$ represent each an oxygen atom or a sulfur atom.

In the lubricating oil composition of the present invention, a single type or a combination of two or more types of above MoDTC can be used as component (A). A single type or a combination of two or more types of above MoDTP can also be used as component (A). A combination of one or more types of MoDTC and one or more types of MoDTP can be used as component (A) as well.

In the lubricating oil composition of the present invention, the content of component (A) is preferably in the range of 0.05 to 10% by weight based on the total weight of the composition. When the content is less than 0.05% by weight, a sufficient effect of decreasing the friction coefficient cannot be obtained. When the content is more than 10% by weight, the effect of improving the friction property is not obtained to the degree expected from the content, and rather economic disadvantage is caused. In view of the effect of decreasing the friction coefficient and the economy, the content of component (A) is more preferably in the range of 0.1 to 3% by weight based on the total weight of the composition. In view of the effect of decreasing the friction coefficient and the economy, the content of molybdenum is preferably 50 to 10,000 ppm by weight, more preferably 100 to 3,000 ppm by weight, based on the total weight of the composition.

The effect of above MoDTC and/or MoDTP of component (A) as the friction modifier is decreased by the effect of degradation acids formed by progressive degradation of the lubricating oil or by the effect of degradation products of fuel mixed with the oil when the oil is used as the engine oil. In the lubricating oil composition of the present invention, an aromatic compound having at least one functional group selected from the group consisting of hydroxyl group, carboxyl group, mercapto group, and thiocarboxyl group on the aromatic ring is used as component (B) for the purpose of suppressing the decrease in the effect of component (A). The aromatic compound is not particularly limited. Examples of the aromatic compound include compounds having benzene ring, naphthalene ring, or anthracene ring. Among these compounds, compounds having one benzene ring or one condensed ring are preferable, and compounds having one benzene ring are more preferable in view of the effect.

As the aromatic compound of component (B), a compound having one or more of one group selected from the above functional groups on the aromatic ring or a compound having one or more of two or more different groups selected from the above functional groups on the aromatic ring can be used. A compound having a suitable substituent, such as an alkyl group or an alkoxy group having 1 to 20 carbon atoms and amino group, on the aromatic ring in addition to the above functional group can also be used. A compound having an electron donating group is preferable as the compound having a substituent on the aromatic ring in addition to the functional group.

As the above aromatic compound of component (B), an aromatic compound having a stereochemical structure in which the functional group is not shielded (such as a stereochemical structure having the functional group at the m- or p-position) is preferable. Therefore, for example, a compound which has a substituent having 3 or more carbon atom at a position next to the functional group (for example, at the o-position) is not preferable because the effect of the functional group (such as the ability of adsorption) is reduced.

Examples of the above aromatic compound include phenol, cresol, xylenol, naphthol, catechol, resorcinol, hydroquinone, m- and p-tert-butylphenols, thiophenol, thiocresol, thioxylenol, thionaphthol, benzoic acid, toluic acid, m- and p-tert-butylbenzoic acids, alkylbenzoic acids, naphthoic acid, thiobenzoic acid, thiotoluic acid, m- and p-tert-butylthiobenzoic acids, thionaphthoic acid, o-, m-, and p-hydroxybenzoic acids, hydroxynaphthoic acids, o-, m-, and p-aminobenzoic acids, o-, m-, and p-mercaptobenzoic acids, o-, m-, and p-hydroxythiobenzoic acids, o-, m-, and p-mercaptothiobenzoic acids, mercaptonaphthoic acids, hydroxythionaphthoic acids, and mercaptothiobenzoic acids. Among these compounds, compounds having the skeleton of benzoic acid or thiobenzoic acid are preferable in view of the effect, and preferable examples of such compounds include alkyl benzoic acids, thiobenzoic acid, aminobenzoic acids, and p-tert-butylbenzoic acid.

A single type or a combination of two or more types of the aromatic compound of component (B) can be used. The content of the aromatic compound of component (B) is preferably in the range of 0.01 to 2% by weight based on the total weight of the composition. When the content is less than 0.01% by weight, the effect of maintaining the low friction property is not sufficiently exhibited. When the content is more than 2% by weight, the initial friction coefficient tends to be increased as opposed to the expectation. In view of the effect to maintain the low friction property and to suppress increase in the initial friction coefficient, the content of component (B) is more preferably in the range of 0.05 to 1% by weight, In the lubricating oil composition of the present invention, other additives, such as antioxidants, ashless dispersants, metallic detergents, extreme pressure agents, antiwear agents, viscosity index improvers, pour point depressants, rust preventives, corrosion inhibitors for metals, defoaming agents, surfactants, and coloring agents, may suitably be used in accordance with necessity within the range that the object of the present invention is not adversely affected.

As the antioxidant, hindered phenol antioxidants and amine antioxidants are preferably used. Examples of the hindered phenol antioxidant include 4,4'-methylenebis(2,6-di-t-butylphenol), 4,4'-bis(2,6-di-t-butylphenol), 4,4'-bis(2-methyl-6-t-butylphenol), 2,2'-methylenebis(4-ethyl-6-t-butylphenol), 2,2'-methylenebis(4-methyl-6-t-butylphenol), 4,4'-butylidenebis(3-methyl-6-t-butylphenol), 4,4'-isopropylidenebis(2,6-di-t-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-t-butyl-4-methylphenol, 2,6-di-t-butyl-4-ethylphenol, 2,4-dimethyl-6-t-butylphenol, 2,6-di-t-α-dimethylamino-p-cresol, 2,6-di-t-butyl-4-(N,N'-dimethylaminomethylphenol), 4,4'-thiobis(2-methyl-6-t-butylphenol), 4,4'-thiobis(3-methyl-6-t-butylphenol), 2,2'-thiobis(4-methyl-6-t-butylphenol), bis(3-methyl-4-hydroxy-5-t-butylbenzyl) sulfide, bis(3,5-di-t-butyl-4-hydroxybenzyl) sulfide, n-octadecyl-3-(4-hydroxy-3,5-di-t-butylphenyl) propionate, and 2,2'-thio[diethyl-bis-3-(3,5-di-t-butyl-4-hydroxyphenyl) propionate]. Among these antioxidants, bisphenol antioxidants and phenolic antioxidants containing an ester group are preferable.

Examples of the amine antioxidants include monoalkyldiphenylamine antioxidants, such as monooctyldiphenylamine and monononyldiphenylamine; dialkyldiphenylamine antioxidants, such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, and 4,4'-dinonyldiphenylamine; polyalkyl-diphenylamines, such as tetrabutyldiphenylamine, tetrahexyldiphenylamine, tetraoctyldiphenylamine, and tetranonyldiphenylamine; naphthylamine antioxidants, such as α-naphthylamine and phenyl-α-naphthylamine; and phenyl-α-naphthylamine antioxidants substituted with an alkyl group, such as butylphenyl-α-naphthylamine, pentylphenyl-α-naphthylamine, hexylphenyl-α-naphthylamine, heptylphenyl-α-naphthylamine, octylphenyl-α-naphthylamine, and nonyl-phenyl-α-naphthylamine. Among these antioxidants, dialkyldiphenylamine antioxidants and naphthylamine antioxidants are preferable.

Examples of the ashless dispersant include succinimides, succinimides containing boron, benzylamines, benzylamines containing boron, esters of succinic acid, and amides of monovalent or divalent carboxylic acids, such as fatty acids and succinic acid. Examples of the metallic detergent include neutral metal sulfonates, neutral metal phenates, neutral metal salicylates, neutral metal phosphonates, basic sulfonates, basic phenates, basic salicylates, basic phosphonates, perbasic sulfonates, perbasic phenates, perbasic salicylates, and perbasic phosphonates.

Examples of the extreme pressure agent and the antiwear agent include compounds containing sulfur, such as sulfurized oils and fats, sulfurized olefins, dialkyl polysulfides, diaryl alkyl polysulfides, and diaryl polysulfides; compounds containing phosphorus, such as esters of phosphoric acid, esters of thiophosphoric acid, esters of phosphorous acid, alkyl hydrogenphosphites, ester amine salts of phosphoric acid, and ester amine salts of phosphorous acid; compounds containing chlorine, such as chlorinated oils and fats, chlorinated paraffins, chlorinated esters of fatty acids, and chlorinated fatty acids; ester compounds, such as esters of alkylmaleic acid and alkenylmaleic acid and esters of alkylsuccinic acid and alkenylsuccinic acid; organic acids, such as alkylmaleic acid, alkenylmaleic acid, alkylsuccinic acid, and alkenylsuccinic acid; and organometallic compounds, such as salts of naphthenic acid, zinc dithiophosphate (ZnDTP), and zinc dithiocarbamate (ZnDTC).

Examples of the viscosity index improver include polymethacrylates, polymethacrylates of the dispersion type, olefinic copolymers (such as ethylene-propylene copolymer), olefinic copolymers of the dispersion type, and styrenic copolymers (such as hydrogenated styrene-diene copolymer). Examples of the pour point depressant include polymethacryates.

Examples of the rust preventive include alkenylsuccinic acids and partial esterification products of alkenylsuccinic acids. Examples of the corrosion inhibitor for metals include benzotriazoles, benzimidazoles, benzothiazoles, and thiadiazoles. Examples of the defoaming agent include dimethylpolysiloxane and polyacrylates. Examples of the surfactant include polyoxyethylene alkylphenyl ethers.

The lubricating oil composition of the present invention is advantageously used as a lubricating oil for internal combustion engines.

The present invention is described in more detail in the following with reference to examples. However, the present invention is not limited by the examples.

Examples 1 to 11 and Comparative Examples 1 to 4

The effect of MoDTC or MoDTP is decreased by the degradation acids and various types of polar substances which are mixed or formed during the use of a lubricating oil. Therefore, an artificial degradation product containing lower fatty acids as the main components was used to represent degradation acids and various types of polar substances. The decrease in the effect of MoDTC or MoDTP was reproduced by adding the artificial degradation product to a lubricating oil composition containing MoDTC or MoDTP. The effect of various compounds to suppress the decrease was examined by using the compositions containing MoDTC or MoDTP and the artificial degradation product. The test method is described in the following.

To gasoline engine oil, 5W-20, of the API SG grade, MoDTC or MoDTP was added in such an amount that the content of Mo was 500 ppm by weight, and reference oils having the following properties were prepared: kinematic viscosity at 40° C.: 44.23 $mm^2$/sec; kinematic viscosity at 100° C.: 8.309 $mm^2$/sec; kinematic viscosity index: 166; total acid number: 1.74 mgKOH/g; base number: 5.51 mgKOH/g; and content of Mo: 500 ppm by weight.

Then, a compound shown in Table 1 was added to one of the above reference oils in an amount shown in Table 1 based on the total weight of the composition. Thus, lubricating oil compositions were prepared.

With the lubricating oil compositions prepared above, measurements were made in accordance with the block-on-ring test (ASTM D-2714) under the following conditions. The friction coefficient was measured 8 minutes after the start of the test, and the obtained value was used as the initial friction coefficient. Immediately after the measurement of the initial friction coefficient, the artificial degradation product was added, and the friction coefficient was measured 8 minutes after the addition (16 minutes after the start of the test). The lubricating oil compositions were evaluated by these measurements. The results are shown in Table 1.

The artificial degradation product, MoDTC, and MoDTP used in the test were as follows:

| |
|---|
| artificial degradation product: |
| an artificial degradation product containing lower fatty acids as the main components; added to the composition in such an amount that the content of the lower fatty acids was about 0.1% by weight based on the total weight of the composition. |
| MoDTC: |
| a compound represented by general formula (I) wherein $R^1$ to $R^4$ = alkyl groups having 8 carbon atoms and alkyl groups having 13 carbon atoms mixed in one molecule. |
| MoDTP: |
| a compound represented by general formula (II) wherein $R^5$ to $R^8$ = alkyl groups having 8 carbon atoms. |

TABLE 1

| | type of | added compound | | initial friction coefficient (after 8 | friction coefficient after addition of artificial degradation product (after |
|---|---|---|---|---|---|
| | Mo compound | type | amount (% by wt.) | min.) [$\mu$] | 16 min.) [$\mu$] |
| Example 1 | MoDTC | phenol | 0.1 | 0.051 | 0.090 |
| Example 2 | MoDTC | catechol | 0.1 | 0.051 | 0.085 |
| Example 3 | MoDTC | p-t-butyl-benzoic acid | 0.1 | 0.051 | 0.069 |
| | | | 0.3 | 0.056 | 0.074 |
| | | | 0.5 | 0.055 | 0.069 |
| Example 4 | MoDTC | thiocresol | 0.1 | 0.064 | 0.095 |
| Example 5 | MoDTC | thiophenol | 0.1 | 0.052 | 0.081 |
| Example 6 | MoDTC | thiobenzoic acid | 0.1 | 0.053 | 0.058 |
| | | | 0.2 | 0.060 | 0.063 |
| | | | 0.3 | 0.063 | 0.065 |
| Example 7 | MoDTC | thiosalicylic acid | 0.1 | 0.062 | 0.087 |
| Comparative Example 1 | MoDTC | — | — | 0.051 | 0.103 |
| Comparative Example 2 | MoDTC | lauryl alcohol | 0.1 | 0.056 | 0.100 |
| Comparative Example 3 | MoDTC | caprylamine | 0.1 | 0.114 | 0.108 |
| Example 8 | MoDTP | thiobenzoic acid | 0.2 | 0.056 | 0.062 |
| Comparative Example 4 | MoDTP | – | — | 0.052 | 0.108 |
| Example 9 | MoDTC | p-n-octylbenzoic acid | 0.1 | 0.047 | 0.079 |
| Example 10 | MoDTC | m-aminobenzoic acid | 0.1 | 0.048 | 0.065 |
| Example 11 | MoDTC | p-aminobenzoic acid | 0.1 | 0.057 | 0.072 |

Conditions of the block-on-ring test

| | |
|---|---|
| block material: | SAE01 STEEL Rc58-63 |
| ring material: | SAE4620, STEEL Rc58-63 |
| radius of the ring: | 17.5 mm |
| width of the ring: | 6.0 mm |
| speed of rotation: | 1400 rpm |
| load: | 89.2 N |
| temperature of the oil: | 80° C. |

INDUSTRIAL APPLICABILITY

The lubricating oil composition maintains the low friction property to achieve sustained low fuel consumption during the use and also enables using the organic molybdenum compound added as the friction modifier in a smaller amount than the amount required in conventional lubricating oil compositions. The lubricating oil composition is particularly advantageously used as a lubricating oil for internal combustion engines.

I claim:

1. A lubricating oil composition comprising a base oil, (A) at least one compound selected from the group consisting of molybdenum dithiocarbamate and molybdenum dithiophosphate, and (B) an aromatic compound having at least one functional group selected from the group consisting of hydroxyl group, carboxyl group, mercapto group, and thiocarboxyl group on the aromatic ring, wherein the aromatic compound of component (B) is free from a substituent having 3 or more carbon atoms at the position next to the functional group, and wherein the composition contains 0.05 to 10% by weight of component (A) and 0.01 to 2% by weight of component (B) based on the total weight of the composition.

2. A lubricating oil composition according to claim 1 wherein the aromatic compound of component (B) has the skeleton of benzoic acid or thiobenzoic acid.

3. A method of lubricating an internal combustion engine, comprising using as a lubricant a composition according to claim 1.

* * * * *